US007331160B2

(12) United States Patent
Melchoir

(10) Patent No.: US 7,331,160 B2
(45) **Date of Patent: *Feb. 19, 2008**

(54) TOP FILLED RECLOSABLE PACKAGE WITH SEPARATE MEMBRANE AND METHOD FOR FORMING AND FILLING THE SAME

(75) Inventor: Greg W. Melchoir, Green Bay, WI (US)

(73) Assignee: Reynolds Consumer Products, Inc., Richmond, VA (US)

( * ) Notice: Subject to any disclaimer, the term of this patent is extended or adjusted under 35 U.S.C. 154(b) by 218 days.

This patent is subject to a terminal disclaimer.

(21) Appl. No.: 11/005,781

(22) Filed: Dec. 7, 2004

(65) Prior Publication Data

US 2005/0178087 A1 Aug. 18, 2005

Related U.S. Application Data

(63) Continuation-in-part of application No. 10/742,000, filed on Dec. 19, 2003, now Pat. No. 6,845,598.

(51) Int. Cl.
*B65B 61/18* (2006.01)

(52) U.S. Cl. ..... 53/412; 53/469; 53/133.4; 53/139.2

(58) Field of Classification Search ..... 53/412, 53/455, 469, 570, 133.4, 139.2; 493/213, 493/214, 394, 927; 383/63–65
See application file for complete search history.

(56) References Cited

U.S. PATENT DOCUMENTS

| | | | | |
|---|---|---|---|---|
| 4,925,316 | A | 5/1990 | Van Erden et al. | |
| 5,067,822 | A | 11/1991 | Wirth et al. | 383/61 |
| 5,198,055 | A | 3/1993 | Wirth et al. | 156/66 |
| 5,330,269 | A | 7/1994 | Kamada et al. | |
| 5,337,539 | A * | 8/1994 | Barton | 53/413 |
| 5,647,671 | A * | 7/1997 | May | 383/210 |
| 5,911,508 | A * | 6/1999 | Dobreski et al. | 383/5 |
| 5,964,532 | A | 10/1999 | St. Phillips et al. | |
| 6,071,011 | A | 6/2000 | Thomas et al. | 383/64 |
| 6,148,588 | A | 11/2000 | Thomas et al. | 53/412 |
| 6,279,298 | B1 | 8/2001 | Thomas et al. | 53/412 |
| 6,427,421 | B1 * | 8/2002 | Belmont et al. | 53/412 |
| 6,467,956 | B1 | 10/2002 | Tilman et al. | 383/61.3 |
| 6,845,598 | B1 * | 1/2005 | Melchoir | 53/412 |
| 6,986,377 | B2 * | 1/2006 | Johnson et al. | 156/581 |

(Continued)

OTHER PUBLICATIONS

Complete File history of U.S Appl. No. 11/005,782.

*Primary Examiner*—Rinaldi I. Rada
*Assistant Examiner*—Gloria R. Weeks
(74) *Attorney, Agent, or Firm*—Merchant & Gould P.C.

(57) ABSTRACT

A method of forming and sealing a flexible, reclosable package having a zipper closure and a slider mounted thereon. The reclosable package is initially formed having a pair of opposing side panels and a zipper closure extending between the pair of side panels. The zipper closure is initially attached to the side panels only along a pair of spaced side seals. The reclosable package is filled with product through a fill opening created between the zipper closure and either one of the side panels. Once the package is filled with product, the attachment flanges of the zipper closure are sealed to both of the side panels. Thus, the zipper closure is sealed to the side panels only after product has been inserted into the product package.

21 Claims, 6 Drawing Sheets

U.S. PATENT DOCUMENTS 7,081,176 B2 * 7/2006 Johnson et al. ..... 156/66
2005/0135710 A1 * 6/2005 Melchoir ..... 383/63
2006/0185325 A1 * 8/2006 Buchman et al. ..... 53/412

* cited by examiner

TOP FILLED RECLOSABLE PACKAGE WITH SEPARATE MEMBRANE AND METHOD FOR FORMING AND FILLING THE SAME

CROSS-REFERENCE TO RELATED APPLICATIONS

This application is a continuation-in-part of application Ser. No. 10/742,000, filed on Dec. 19, 2003 now U.S. Pat. No. 6,845,598.

FIELD OF THE INVENTION

The present invention generally relates to reclosable packages having a zipper closure mechanism and a slider device for facilitating opening and closing of the zipper closure mechanism. More specifically, the invention relates to a method of filling the reclosable package with a product and closing the reclosable package after the package has been filled.

BACKGROUND OF THE INVENTION

Flexible packages, and particularly resealable and reclosable packages, are frequently used for packaging consumable products. Products that are not completely used when the package is initially opened rely upon a zipper closure to reclose the package and keep the remaining contents fresh. Examples of consumable products that are often provided in reclosable packages with a zipper closure include potting soil, fertilizer, pet food, dog biscuits, vegetables, cereal and many different types of food, such as cheese, edible by humans.

Often, the opening and closing of the zipper closure is facilitated by a slider device that is mounted on the zipper closure. The slider device is constructed to pry apart the interlocking zipper closure members when the slider device is moved in a first direction and to engage the interlocking zipper closure members when the slider device is moved in a second, opposite direction. For some applications, a tamper-evident structure is desired to indicate whether access has been gained to the zipper closure.

As discussed above, a typical reclosable package includes a pair of opposing side panels joined to each other along a pair of side seals and a bottom wall that extends between the side panels to define a three-sided, open package interior. The reclosable zipper closure extends along an open mouth of the package opposite the bottom wall. The zipper closure includes a first profile member and a second profile member that are adapted to resealably interlock with each other.

If reclosable packages are to be prepackaged with a product and sold in the stores, the packages are typically prepared on a horizontal or vertical form, fill and seal machine. In this type of machine, the reclosable package is first formed into the shape of a pouch having a fill opening at either the top or the bottom. If the fill opening is disposed at the bottom of the package, the zipper closure is attached between the side panels and the top of the package is sealed prior to filling the product into the package.

If the package is designed to be filled from the top, the bottom is initially sealed prior to filling of the product. Next, the package is filled with product through a fill opening near the mouth of the package.

One method of top filling a package with product is to fill the product through the zipper closure when the first and second profile elements of the zipper closure are in an unmated condition. This type of filling is typically referred to as the "fill through the zipper" method. Once the product has been placed into the package interior, the zipper closure is either mated or left unmated and the top edges of the package are sealed. This type of filling arrangement includes several inherent disadvantages, such as the requirement that the zipper closure must be mated after filling.

Alternatively, U.S. Pat. No. 6,071,011 teaches a method of attaching the zipper closure to only one of the side panels prior to the product being inserted into the package interior. The package is then filled with product through a fill opening between the zipper closure and the opposite side panel to which the zipper closure is not yet attached. After the package interior has been filled with product, the zipper closure is sealed to the opposite side panel and the top of the package sealed. The method taught by the '011 patent provides the advantage of allowing the zipper closure to remain in the mated condition during package filling. Improvements to this type of method of filling are desired.

SUMMARY OF THE INVENTION

The present invention is directed to a flexible, reclosable package that has a zipper closure extending across the mouth of the reclosable package. The zipper closure preferably includes a slider device that can be moved along the zipper closure to engage and disengage a pair of profile members.

In accordance with the method of the present invention, a continuous web of plastic material is provided and folded to define opposing first and second side panels. The side panels are preferably joined by a bottom wall such that the side panels and bottom wall define an interior for the reclosable package.

A continuous supply of zipper closure is provided between the first and second opposing sidewalls. The zipper closure is formed from a first profile member and a second profile member that are adapted to releasably interlock with each other. Both the first profile member and the second profile member include a dependent attachment flange that provides a point of attachment between each of the profile members and one of the opposing side panels. In the preferred embodiment of the invention, the zipper closure is supplied as a continuous length having the profile members in a mated condition.

Once the zipper closure is supplied between the side panels, a pair of side seals are created to seal the first and second side panels to each other. The side seals ultimately define the side edges of the reclosable package. During the formation of the side seals, the continuous length of the zipper closure is sealed between the pair of side panels and severed from the continuous length such that the zipper closure extends across the mouth of the package. After being attached to the side panels along the side seals, the zipper is secured to the side panels only along the side seals. Thus, the remaining portion of the zipper closure between the two secured ends is freely movable across the open interior of the reclosable package.

Once the side seals have been created between the first and second opposing side panels to define the open interior of the reclosable package, a product can be inserted into the open interior of the package. Specifically, the product can be inserted into the open interior by allowing the product to pass between the zipper closure and one of the side panels. Since the zipper closure is freely movable across the open interior of the reclosable package, the product can be inserted into the package either between the zipper closure and the first side panel or between the zipper closure and the second side panel. In preferred embodiment of the invention, the zipper closure is moved away from a centerline of the reclosable package by either a mechanical member or other non-mechanical means, such as the application of pressurized air.

Once the zipper closure has been moved away from the centerline of the product package, product is allowed to flow past the zipper closure and into the open interior.

After the desired amount of product has been inserted into the open interior, a pair of sealing bars are brought into contact with the first and second side panels at locations generally aligned with the attachment flanges formed on the first and second profile members. The sealing bars are preferably heated and create a seal between the respective attachment flanges and the first and second opposing side panels. The attachment flanges are sealed to the side panels along the entire width of the product package.

In the first embodiment of the invention, each of the attachment flanges includes a thickened attachment area to prevent the attachment flanges from sealing to each other during application of the attachment flanges to the side panel. Alternatively, each of the attachment flanges can include a heat resistant layer to prevent the attachment flanges from becoming sealed to each other during this process.

Once the product has been loaded into the package and the zipper closure is attached to both of the first and second opposing side panels, the side panels are sealed to each other above the zipper closure. In an alternate embodiment of the invention, a peel-seal is also created between the pair of side panels beneath the zipper closure.

In yet another alternate embodiment of the invention, a membrane is included between the pair of attachment flanges such that the membrane extends across the open interior of the product package prior to opening. The membrane includes a line of weakness such that during initial product opening, the membrane separates to provide access to the package interior. The preferred means of forming the line of weakness is via preferential orientation of the membrane, but various other means including mechanical devices and laser scoring can be used. Preferential orientation of the membrane is the application of pressure oriented toward the middle of the membrane in the direction that the package is extruded.

DETAILED DESCRIPTION OF PREFERRED EMBODIMENTS

Figure 1A:
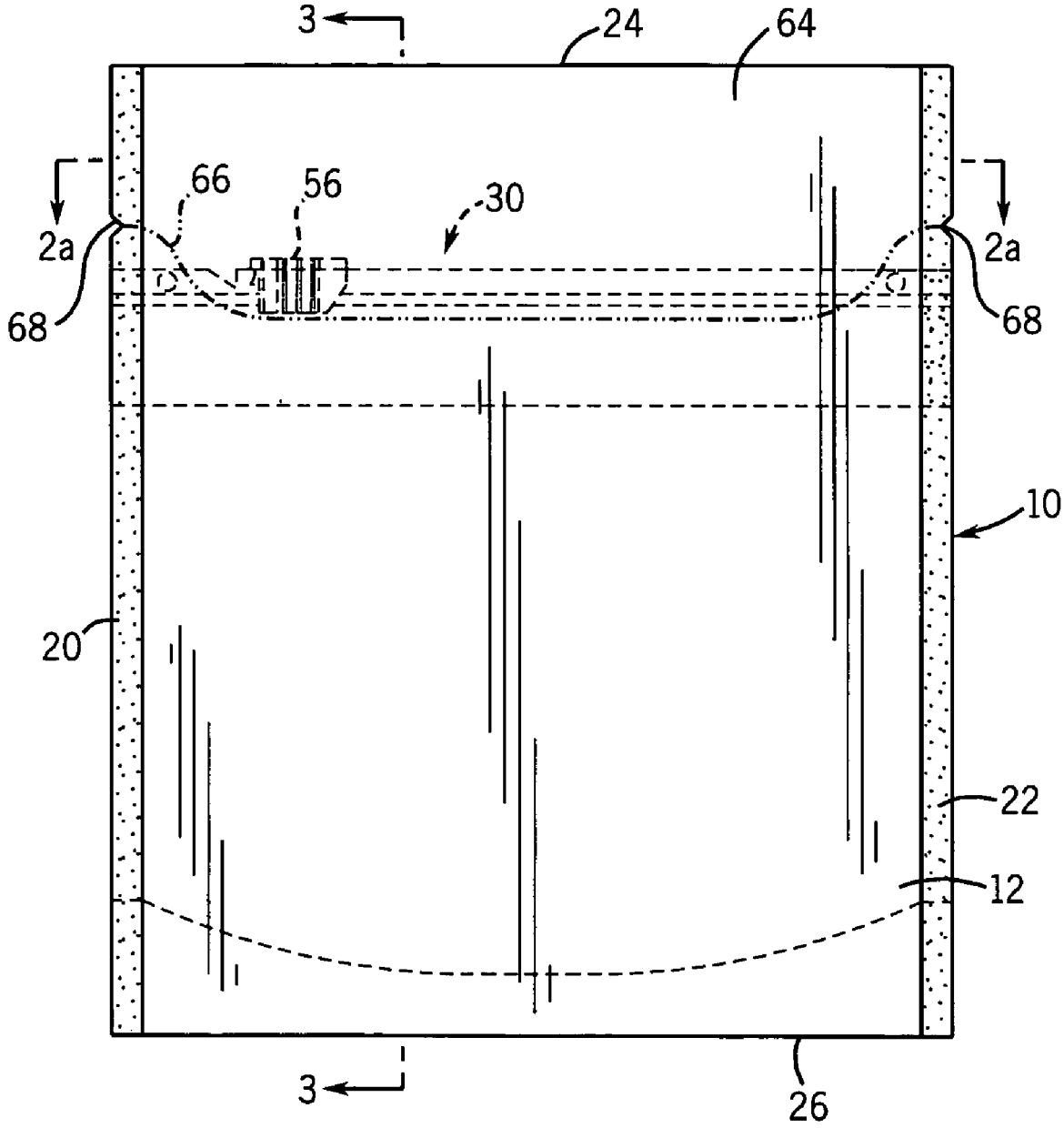
FIG. 1A is a schematic front plan view of a reclosable package having a zipper closure and slider device prior to filling with a product.
Figure 3:
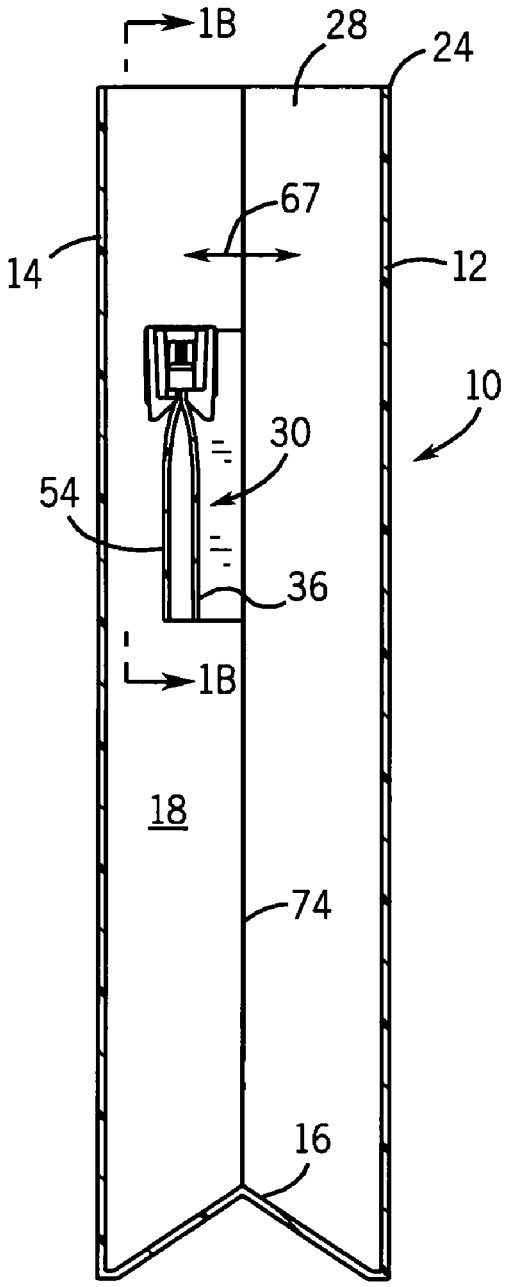
FIG. 3 is a section view taken along line 3-3 of FIG. 1A illustrating the zipper closure prior to insertion of the product into the package.

Referring now to the drawings, FIGS. 1A and 3 depict a reclosable package 10 of the present invention prior to filling with a product. The reclosable package 10 includes a pair of opposed side panels 12, 14 that are joined to each other by a bottom wall 16. In the embodiment of the invention illustrated in FIG. 3, the reclosable package 10 includes a gusseted bottom wall 16 that allows the size of the open package interior 18 to increase as product is filled into the package 10. As can be understood in FIG. 3, the reclosable package 10 is formed from a continuous web of plastic material that defines the side panels 12, 14 as well as the bottom wall 16. However, it should be understood that the reclosable package 10 could be formed from individual sheets of plastic material that define the side panels 12, 14 and that the bottom wall 16 could be replaced by a thermal formed bottom seal formed by the application of heat and pressure.

Referring now to FIG. 1A, the reclosable package 10 is defined by a pair of spaced side seals 20, 22 that extend along the entire height of the package from the top end 24 to the bottom end 26. The side seals 20, 22 are typically formed with a seal bar through the application of both heat and pressure between the pair of side panels 12 and 14.

Although only a single reclosable package 10 is shown in FIG. 1A, the reclosable package 10 is formed in a continuous process from a continuous web of plastic material that is folded to create the pair of side panels 12, 14 and the bottom wall 16, as best shown in FIG. 3. Referring back to FIG. 1A, the side seals 20, 22 separate the individual reclosable package 10 from a continuous chain of reclosable packages. The continuous chain of reclosable packages are formed in accordance with the method and apparatus shown in U.S. Pat. No. 6,412,254, the disclosure of which is incorporated herein by reference. As can be understood, each of the reclosable packages 10 are individually formed and later filled with product in an in-line form, fill and seal process. Alternatively, each of the reclosable packages 10 can be formed and provided to a remote location for filling and sealing at a later time.

Referring now to FIG. 3, the reclosable package 10 defines an open mouth 28 at the top end 24 of the package 10. The open mouth 28 allows product to be inserted into the reclosable package 10 in a manner to be described in greater detail below.

Figure 1B:
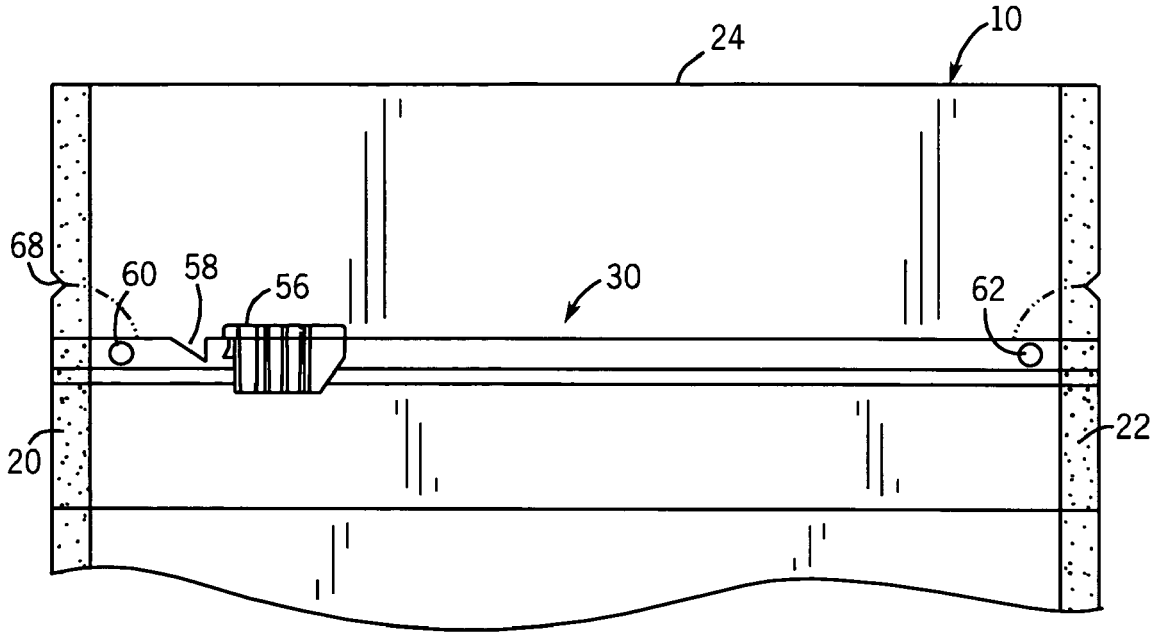
FIG. 1B is an enlarged view of a portion of the reclosable package of FIG. 1A.
Figure 2A:
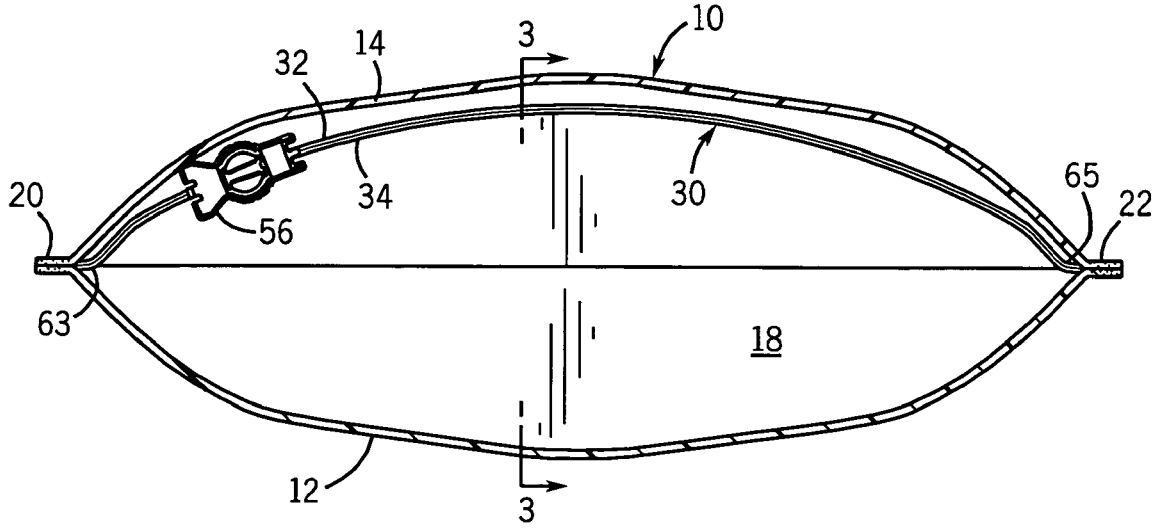
FIG. 2A is a section view taken along line 2A-2A of FIG. 1A illustrating the zipper closure extending across the mouth of the package prior to product filling.

Referring now to FIGS. 1B and 2A, the reclosable package 10 includes a zipper closure 30 positioned near the top end 24 of the reclosable package. The zipper closure 30, as best shown in FIG. 2A, extends across the open interior 18 of the package 10. The zipper closure includes a first profile element 32 and a second profile element 34. Prior to filling with product, the zipper closure 30 extends across the open interior 18 between the pair of spaced side seals 20, 22 and is positioned near the top end 24 of the package 10. The zipper closure 30 can be one of a variety of closure mechanisms while operating within the scope of the present invention. Typically, the first and second profile members 32, 34 are manufactured separately from each other, although in some embodiments, the first and second profile members 32, 34 can be manufactured as a single piece and then slit or otherwise separated prior to incorporation into the reclosable package.

Figure 2B:
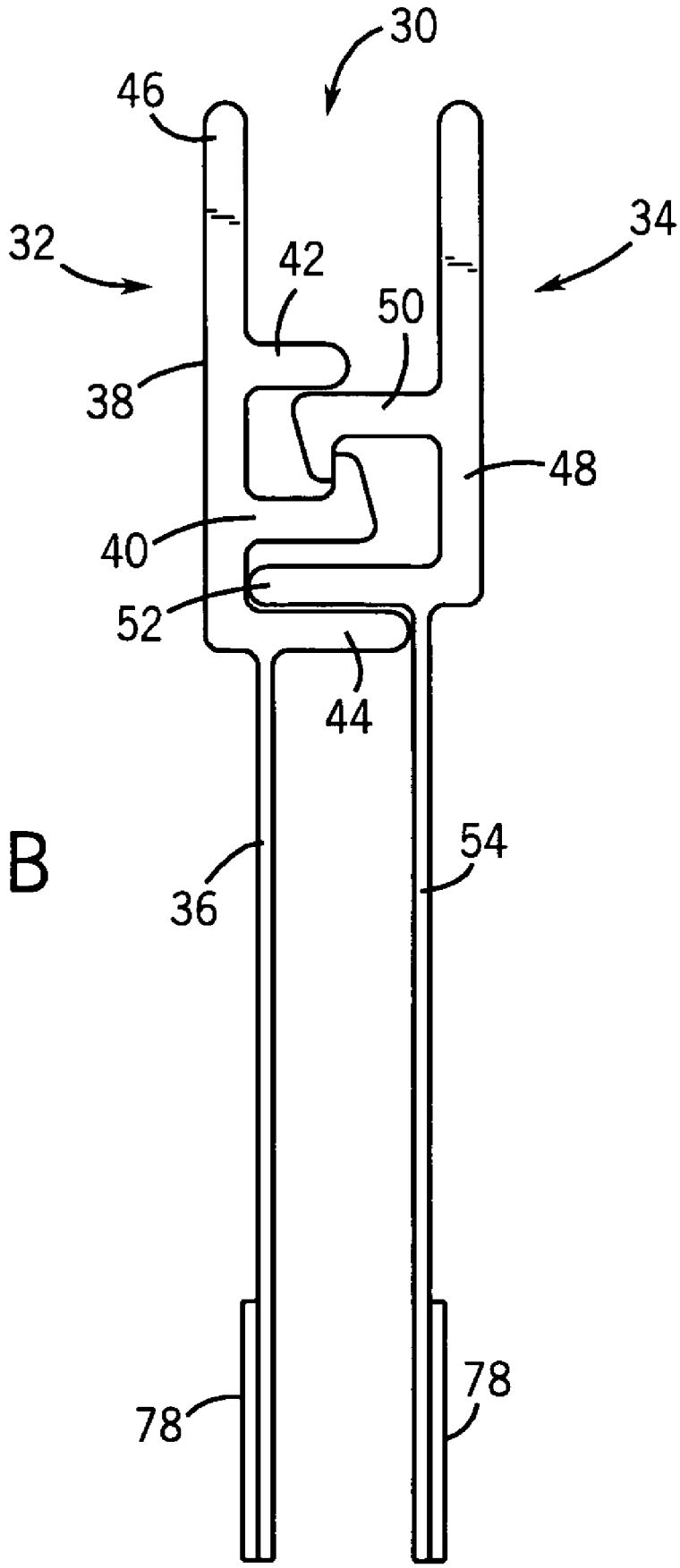
FIG. 2B is a magnified view illustrating the zipper closure used in the preferred embodiment of the invention.

Referring now to FIG. 2B, the preferred zipper closure 30 is shown. As illustrated, the zipper closure 30 includes the first profile element 32 and the second profile element 34. The first profile element 32 includes an attachment flange 36, a base strip 38, a first closure post 40, a pair of guide posts 42, 44 and an upper flange 46. As illustrated, the closure post 40 and the pair of guide posts 42, 44 extend laterally from the base strip 38 while the attachment flange 36 depends or extends downwardly from the guide post 44. Likewise, the second profile element 34 includes a base strip 48, a second closure post 50 and a guide post 52. Both the closure posts 50 and the guide post 52 extend laterally from the base strip 48. An attachment flange 54 is formed as part of the second profile member 34 and depends from the guide post 52.

As can be understood in FIG. 2B, the first and second profile members 32, 34 engage and disengage with each other to open and close the resealable zipper closure 30. Specifically, as pressure is applied to the profile members 32, 34, the closure posts 40 and 50 interact with each other such that the first and second profile members releasably interlock with each other.

Referring now to FIG. 2A, the zipper closure 30 further includes a slider device 56 mounted on the pair of profile members 32, 34 to facilitate the opening and closing of the zipper closure 30. Specifically, the slider device 56 engages and disengages the first and second profile members 32, 34 as the slider is moved along the zipper closure 30 between the side edges 20 and 22.

The slider device 56 includes a separation structure for separating the first and second profile members 32, 34. The separation structure can extend or depend from a top wall of the slider housing. A preferred slider device is taught in U.S. Pat. No. 6,524,002, the disclosure of which is incorporated herein by reference. However, it should be understood that various other configurations for the slider device 56 can be utilized while operating within the scope of the present invention.

Referring now to FIG. 1B, the zipper closure 30 includes a removed notch 58. The removed notch 58 provides a home or parking position for the slider 56. The removed notch 58 allows the separating device of the slider 56 to pass through the zipper closure 30 and permit the package to be fully closed. The zipper closure 30 further includes a slider stops 60 and 62 formed on opposite ends of the zipper closure. The slider stops 60, 62 prevent the slider 56 from traveling any further along the zipper closure 30.

Referring now to FIG. 1A, the reclosable package 10 includes a hood area 64 that extends above the zipper closure 30 and encloses the slider 56 prior to opening of the package. The hood area 64 is formed as a portion of both the first and second side panels and is set off from the remaining portions of the reclosable package by a line of weakness 66. In the preferred embodiment of the invention, the line of weakness 66 is a line of perforations, although the line of weakness could also be formed from a laser score or die line, as required. As can be seen in FIG. 1A, the line of weakness 66 is generally aligned with a notch 68 formed along each side of the reclosable package. The die line 66 includes a curved area and extends below the slider 56, as illustrated. A line of weakness 66 allows the hood area 64 to be removed from the reclosable package 10 once the reclosable package has been formed, filled with product and sealed. The removal of the hood area 64 provides access to the zipper closure 30, and specifically the slider 56, to open and close the reclosable package as is well known.

The preferred method of forming, filling and sealing the reclosable package of the present invention will now be described with reference to the Figures. Referring first to FIGS. 2A and 3, the reclosable package 10 is initially formed by folding a continuous web of plastic material into the condition shown in FIG. 3. In this condition, the continuous web forms the side panels 12, 14 and the bottom wall 16. While the continuous web is being folded to create the side panels 12 and 14, a continuous length of the zipper closure 30 is fed between the side panels 12, 14. The zipper closure 30 is formed from continuous, mated strips that form both the first profile member 32 and the second profile member 34, as best shown in FIG. 2. The continuous length of zipper closure 30 includes individual sliders 56 spaced along the length of the zipper closure 30. The sliders 56 are mounted along the length of the zipper closure at a bag width distance apart from each other such that each reclosable package includes one of the sliders 56. The sliders can be installed onto the zipper closure 30 using various techniques, as is well known in the art.

Once the zipper closure 30 has been fed between the side panels 12, 14 of the continuous web of material, the individual side seals 20, 22 shown in FIG. 1A are formed between the opposed side panels. The side seals 20, 22, along with the bottom wall of the reclosable package, define the open interior 18 of the reclosable package 10, as shown in FIG. 2A. In the preferred embodiment of the invention, the side seals 20, 22 are formed by a heated sealing bar, as is conventional.

Referring back to FIG. 2A, when the side seals 20, 22 are created, the zipper closure 30 is secured at its ends 63 and 65 to both of the side panels 12, 14 along the respective side seals 20, 22. As illustrated in FIG. 2, prior to filling the package with product the zipper closure 30 is not attached to any other portions of the side panels 12, 14, other than along the side seals 20 and 22.

Referring now to FIG. 3, after the side seals 20 and 22 are formed, the entire zipper closure 30, including the attachment flanges 36 and 54, are spaced inwardly from the respective side panels 12, 14. Thus, the zipper closure 30 is movable across the open interior 18 to either side of the centerline between the side panels 12 and 14, as arrow 67.

Figure 4:
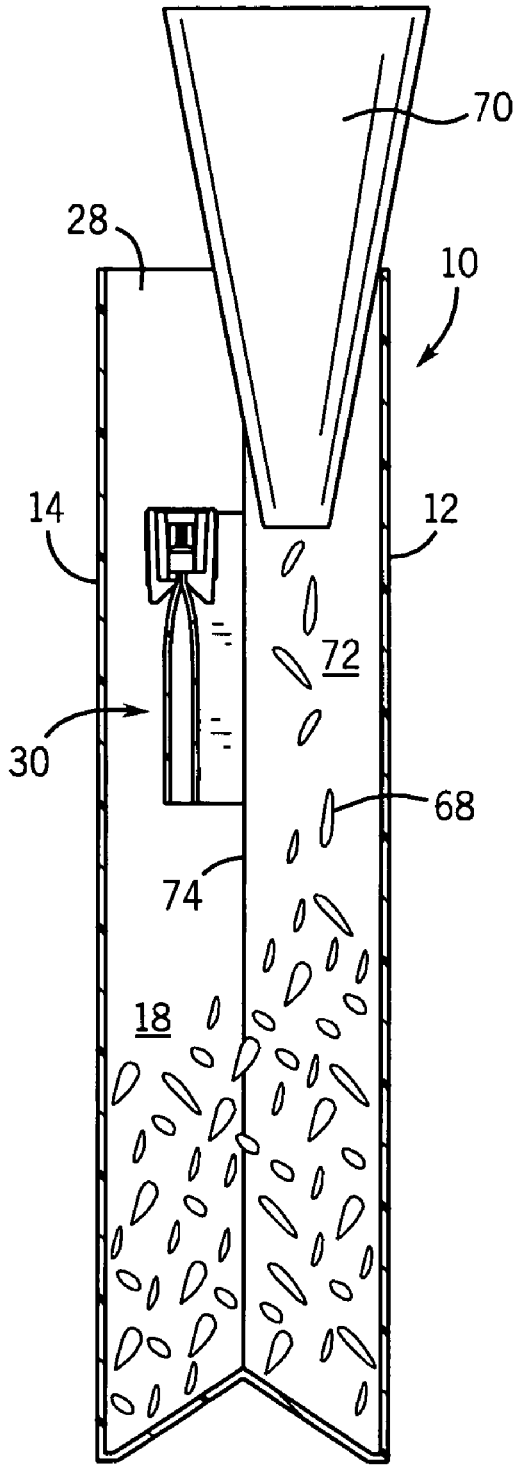
FIG. 4 is a section view illustrating the insertion of product between the zipper closure and one of the package side panels.

Once the reclosable package 10 has been formed, as shown in FIGS. 2A and 3, product 68 can be inserted into the open interior 18, as shown in FIG. 4. In the embodiment of the invention shown in FIG. 4, the product 68 is filled through the open, top mouth 28 of the reclosable package 10. Specifically, a product fill tube 70 is inserted into the open mouth 28 and directs a flow of product through a fill opening 72. In the embodiment of the invention illustrated in FIG. 4, the zipper closure 30 is moved to the left of the centerline 74 and the fill opening 72 is between the zipper closure 30 and the side panel 12. However, it is contemplated that the zipper closure 30 can be moved to the right of the centerline 74 and closer to the side panel 12 such that the fill opening 72 would be defined between the zipper closure 30 and the side panel 14. Since the zipper closure 30 is attached to the side panels 12, 14 only along the side seals 20, 22 (FIG. 2), the zipper closure 30 is movable across the open interior 18 of the reclosable package 10. Thus, the product 68 can be filled past the zipper either between the zipper closure 30 and the first side panel 12 or between the zipper closure 30 and the second side panel 14.

In the preferred embodiment of the invention, the zipper closure 30 is moved away from the centerline 74 by a known movement means. For example, the movement means could be a blast of pressurized air, mechanical fingers, or any other similar device that physically moves the zipper closure 30 to one side of the centerline 74. The movement of the zipper closure 30 away from the centerline 74 creates the fill opening 72 to allow product 68 to be inserted into the open interior 18.

Figure 5:
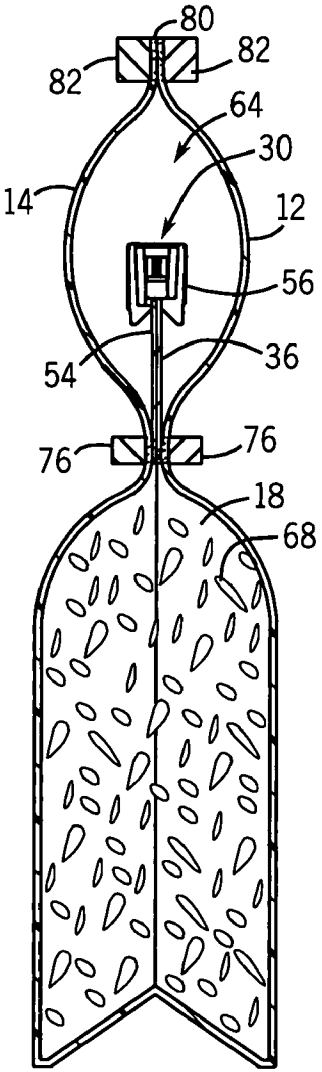
FIG. 5 is a section view illustrating the attachment of the zipper closure to the package side panels.

Referring now to FIG. 5, once the desired amount of product 68 has been loaded into the open interior 18 of the package, the attachment flanges 36 and 54 of the zipper closure 30 are sealed to the side panels 12 and 14. Specifically, the attachment flange 36 of the first profile member is sealed to the first side panel 12, while the attachment flange 54 of the second profile member is secured to the second side panel 14. In the preferred embodiment of the invention, the attachment flanges 36, 54 are sealed to the respective side panels 12, 14 by a pair of sealing bars 76. Specifically, the sealing bars 76 are moved into contact with the side panels 12, 14 beneath the slider 56 of the zipper closure 30 and generally aligned with the bottom edges of the attachment flanges 36 and 54. The sealing bars 76 provide the required heat to bond the attachment flanges 36 and 54 to the side panels 12 and 14.

As illustrated in FIG. 2B, both the attachment flanges 36, 54 include a thickened attachment area 78 near the lower ends of the respective attachment flanges 36, 38. The thickened attachment areas 78 provide additional material to prevent the attachment flanges 36, 54 from sealing to each other during the attachment of the zipper closure 30 to the side panels 12, 14, as shown in FIG. 5. The thickened attachment areas 78 are shown and described in U.S. Pat. No. 5,067,822, the disclosure of which is incorporated herein by reference.

In an alternate embodiment of the invention, each of the attachment flanges 36 and 54 can include a heat resistant layer formed along the inside surface of the respective attachment flange. The heat resistant layer also aids in preventing the attachment flanges 36, 54 from sealing together during the step shown in FIG. 5.

Referring back to FIG. 5, the zipper closure 30, including the slider 56, is included within the hood area 64. The hood area 64 is defined at its top end by a seal 80 formed along the top edge of the reclosable package 10. The seal 80 is created between the side panels 12, 14 and is positioned above the zipper closure 30, as illustrated. The seal 80 is formed by a second pair of sealing bars 82 as illustrated. Preferably, the sealing bars 82 are heated to provide a fusion of the side panels 12, 14 along the top seal 80.

Figure 6:
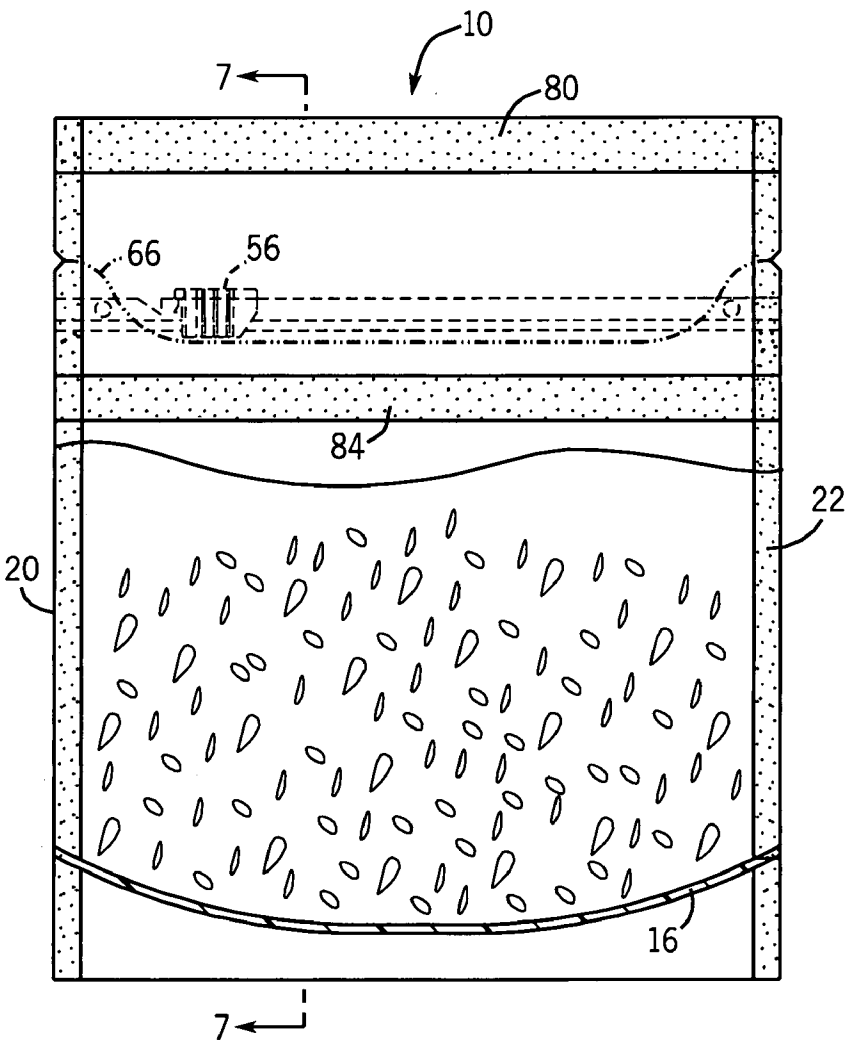
FIG. 6 is a schematic front plan view of the reclosable package after being filled with product.

Referring now to FIG. 6, a flange seal 84 is created between each of the attachment flanges 36, 54 and one of the side panels 12, 14. The flange seal 84 extends across the entire width of the package from the side seal 20 to the side seal 22.

As discussed previously, the line of weakness 66 is formed at each of the side panels 12, 14 and extends below the slider 56 when the reclosable package 10 is in its loaded condition, shown in FIG. 6.

Figure 7:
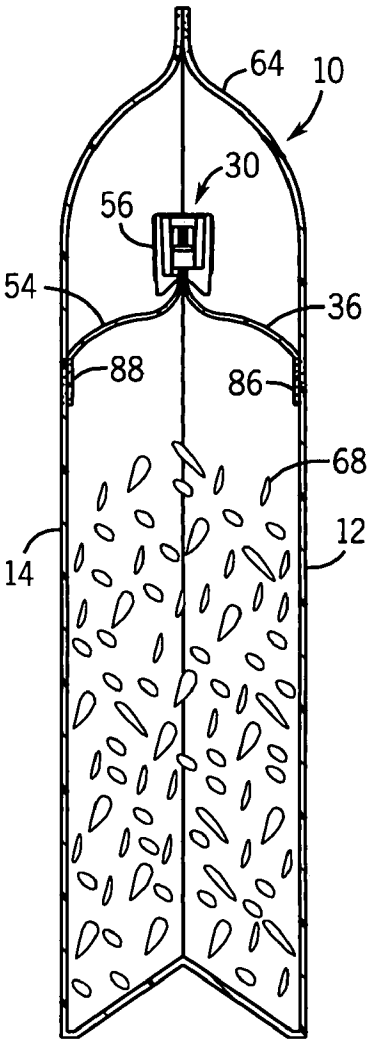
FIG. 7 is a section view taken along line 7-7 of FIG. 6

As illustrated in FIG. 7, when the reclosable package 10 is filled with product 68, the lower ends 86, 88 of the respective attachment flanges 36, 54 are sealed to the respective side panels 12, 14. In this condition, the zipper closure 30 bridges the open interior and allows the reclosable package 30 to be repeatedly opened and closed through the use of the slider 56. As discussed previously, the hood 64 is removable from the reclosable package 10 along the line of weakness 66. Once the hood 64 has been removed, the zipper closure 30 can be used to repeatedly open and close the reclosable package 10.

Figure 8:
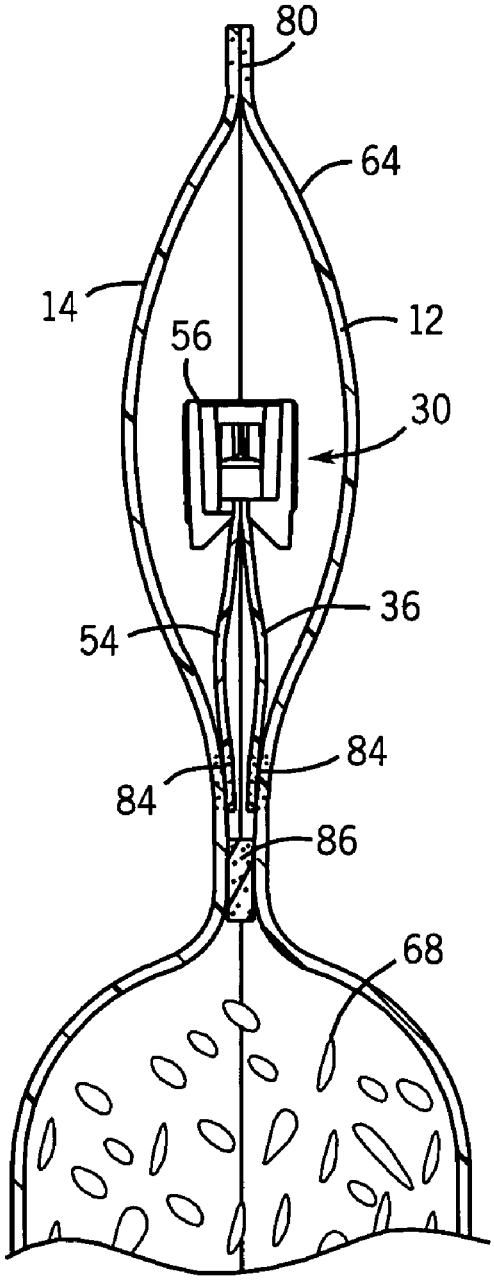
FIG. 8 is an enlarged, partial section view illustrating a second embodiment of the reclosable package.

Referring now to FIG. 8, thereshown is a first alternate embodiment of the reclosable package 10 of the present invention. The alternate embodiment of the reclosable package 10 includes many corresponding elements, the reference numerals of which will be utilized in the following description. As illustrated in FIG. 8, the attachment flanges 36 and 54 are secured to the side panels 12, 14 along the flange seals 84 in a similar manner as described in FIGS. 5-7. However, in the second embodiment of the invention illustrated in FIG. 8, a releasable adhesive 86 is positioned beneath the lowermost portions of the attachment flanges 36, 54 to provide a seal across the width of the reclosable package 10 between the side panels 12, 14. In the preferred embodiment of the invention, the releasable adhesive 86 is a conventional peel-seal. The peel-seal prevents product 68 from contacting the zipper closure 30 prior to initial opening of the package 10. The peel-seal adhesive 86 thus provides another tamper-evident device in the reclosable package 10 of the second embodiment of the invention.

In the preferred embodiment of the invention shown in FIG. 8, the releasable adhesive 86 is applied to one of the side panels 12, 14 prior to product being inserted into the package, as illustrated in step 4. Once product is inserted into the reclosable package 10, the peel-seal adhesive 86 is activated to provide the seal illustrated in FIG. 8. It is contemplated that the releasable adhesive 86 can be applied to either of the side panels 12, 14, or both, while operating within the scope of the present invention.

Figure 9:
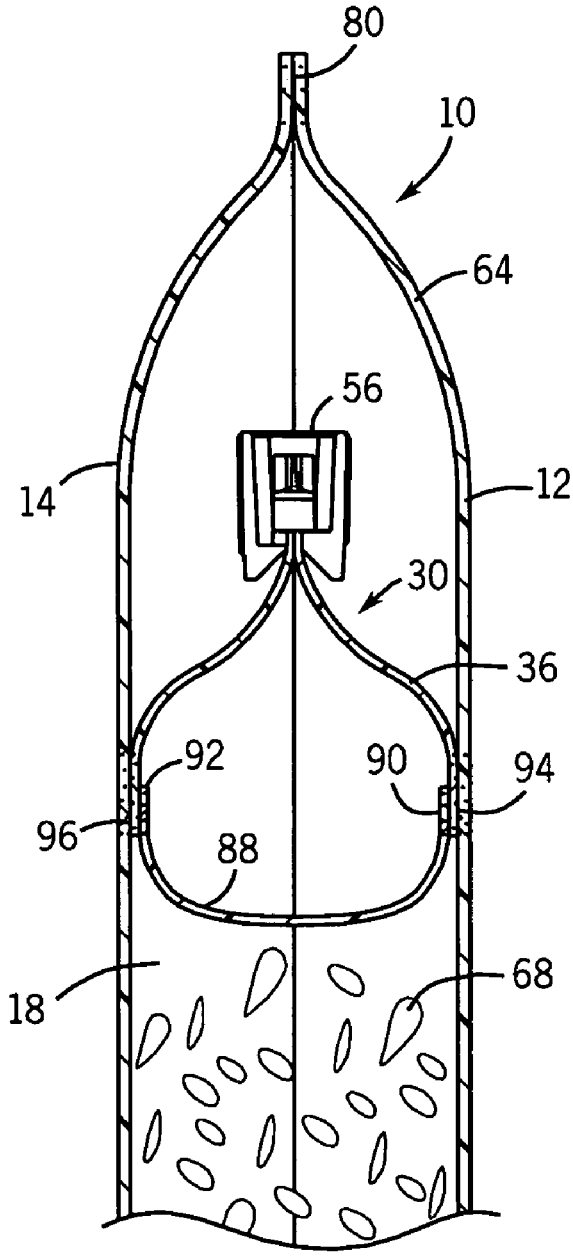
FIG. 9 is an enlarged section view showing a third embodiment of the reclosable package.

Referring now to FIG. 9, thereshown is a third alternate embodiment of the reclosable package 10 of the present invention. In the embodiment of the invention illustrated in FIG. 9, a membrane 88 is formed as part of the zipper closure 30. The membrane 88 may comprise at least one layer of sealant, barrier, or adhesive materials or at least one layer of ionomer resins, such as Surlyn ionomer resins. However, a combination of the materials is usually preferred. The membrane 80 extends between the pair of attachment flanges 36 and 54. Specifically, the first end 90 of the membrane 88 is attached to the outermost end 94 of the attachment flange 36, while the second end 92 is attached to the outermost end 96 of the attachment flange 54. The membrane 88 thus extends across the open interior 18 of the product package 10. The membrane 88, like the releasable adhesive 86 shown in FIG. 8, prevents product 68 from coming into contact with the zipper closure 30 prior to the initial opening of the product package. The membrane 88 includes a line of weakness (not shown) that allows the membrane 88 to separate during initial product opening. Thus, once the reclosable package 10 is opened for the first time, the membrane 88 ruptures and provides access to the product 68.

In addition to providing additional separation between the product 68 and the zipper closure 30, the membrane 88 also serves the additional purpose of preventing the sealing of the attachment flanges 36 and 54 during the attachment process shown in FIG. 5. The increased thickness caused by the ends 90, 92 of the membrane, prevent the attachment flanges 36, 54 from sealing together.

In the preferred embodiment of the invention, the membrane 88 is integrally formed with the mating first and second profile members. The membrane 88 is preferably coextruded with the zipper closure, but can be fused with the zipper closure or adhesively attached in a separate processing step.

Having described the presently preferred embodiments, it is to be understood that the invention may be otherwise embodied within the scope of the appended claims.

What is claimed is:

1. A method of making and filling a reclosable package comprising the steps of:

supplying a continuous web of plastic material folded to define first and second opposing side panels joined by a bottom wall;

supplying a zipper closure between the first and second opposing side panels, the zipper closure including a first profile member and a second profile member adapted to releasably interlock with each other;

sealing the first and second opposing side panels to each other along a pair of spaced side seals to define an open bag interior therebetween, wherein the zipper closure is attached to the first and second side panels only at the pair of spaced side seals;

filling the package with a product, the product passing between the zipper closure and one of the side panels; and attaching the first profile member to the first side panel and the second profile member to the second side panel after the package has been filled with product.

2. The method of claim 1 wherein the zipper closure is supplied as a continuous length of zipper closure.

3. The method of claim 1 wherein the first and second profile members each include a depending attachment flange, wherein the attachment flange of each profile member is attached to one of the side panels.

4. The method of claim 3 wherein each of the attachment flanges includes a heat resistant layer to prevent sealing of the attachment flanges to each other during the attachment of the first and second profile elements to the side panels.

5. The method of claim 3 wherein each of the attachment flanges include a thickened portion to prevent the sealing of the attachment flanges to each other during the attachment of the male and female profile elements to the side panel.

6. The method of claim 3 wherein the zipper closure includes a membrane positioned between the attachment flanges of the first and second profile members, wherein the membrane extends across the bag interior when the attachment flanges are attached to the opposing side panels.

7. The method of claim 6 wherein said membrane is a separate component attached to said attachment flanges via a fusion, adhesive, or co-extrusion process, wherein said membrane incorporates one or more thickened areas.

8. The method of claim 7 further comprising the step of moving the zipper closure toward one of the side panels prior to filling the reclosable package with product.

9. The method of claim 7 wherein the step of attaching the zipper closure to the side panels after the package has been filled with product includes attaching the attachment flange of the first profile member to the first side panel and attaching the attachment member of the second profile member to the second side panel.

10. The method of claim 7 further comprising the step of sealing the first and second side panels to each other above the zipper closure and between the pair of spaced side seals after the package has been filled with product.

11. The method of claim 6 wherein said membrane comprises at least one layer of sealant, barrier, or adhesive materials or at least one layer of ionomer resins.

12. The method of claim 11 wherein said ionomer resins comprises Surlyn ionomer resins.

13. The method of claim 11 wherein the step of moving the zipper closure toward one of the side panels includes utilizing a flow of air to move the zipper closure.

14. The method of claim 11 wherein the step of moving the zipper closure toward one of the side panels includes utilizing a mechanical finger to move the zipper closure.

15. The method of claim 6 wherein said membrane includes a line of weakness that allows said membrane to separate during opening of the package.

16. The method of claim 15 wherein said line of weakness is formed from means comprising mechanical devices, laser scoring, or preferential orientation of the membrane.

17. The method of claim 1 wherein the bottom wall is gusseted.

18. The method of claim 1 wherein the spaced side seals are created by the application of heat to the pair of opposing side panels.

19. The method of claim 1 further comprising the step of sealing the first and second side panels to each other above the zipper closure and between the pair of spaced side seals after the package has been filled with product.

20. The method of claim 19 further comprising the step of creating a releasable seal between the first side panel and the second side panel after the package has been filled with product, the releasable seal being positioned below the zipper closure.

21. The method of claim 1 wherein the zipper closure includes a slider movable along the zipper closure.

* * * * *